United States Patent [19]

Fibranz

[11] Patent Number: 4,593,622

[45] Date of Patent: Jun. 10, 1986

[54] INDUSTRIAL CARTRIDGE WITH SEPARATED DEFLAGRATING COMPONENTS

[75] Inventor: Joachim Fibranz, Fürth, Fed. Rep. of Germany

[73] Assignee: Dynamit Nobel Aktiengesellschaft, Fed. Rep. of Germany

[21] Appl. No.: 652,010

[22] Filed: Sep. 19, 1984

[30] Foreign Application Priority Data

Sep. 23, 1983 [DE] Fed. Rep. of Germany ..... 3334464

[51] Int. Cl.[4] ..... F42B 9/02

[52] U.S. Cl. ..... 102/530; 102/516; 102/282; 102/517; 102/315; 102/464; 102/331; 102/465; 102/441

[58] Field of Search ..... 102/282, 315, 331, 441, 102/464, 465, 516, 517, 530

[56] References Cited

U.S. PATENT DOCUMENTS

| | | | |
|---|---|---|---|
| 3,276,378 | 10/1966 | Gähle | 102/530 |
| 3,295,448 | 1/1967 | Gähle | 102/530 |
| 3,672,301 | 6/1972 | Abbott | 102/530 |
| 3,902,934 | 9/1975 | Timmerman | 102/531 X |
| 3,911,825 | 10/1975 | Gawlick et al. | 102/531 X |
| 3,982,467 | 9/1976 | Smith et al. | 102/380 X |
| 4,313,380 | 2/1982 | Martner et al. | 102/317 X |
| 4,365,555 | 12/1982 | Galluzzi et al. | 102/204 |
| 4,449,458 | 5/1984 | Buckley et al. | 102/530 X |

*Primary Examiner*—Peter A. Nelson

*Attorney, Agent, or Firm*—Antonelli, Terry & Wands

[57] ABSTRACT

An industrial cartridge has a case that contains a propellant charge of at least two successively arranged propellant charge powders deflagrating at differing speeds. The powders are separated from each other by a gas-permeable cover extending transversely to the case axis. The case of the cartridge contains a compressible seal at the opposite end to the base end of the case. An ignition-transmitting tube is axially arranged in the case. The tube includes, at the level of the second and/or last propellant charge powder as seen from the base, a cover which is thinner than the wall of the ignition-transmitting tube.

11 Claims, 1 Drawing Figure

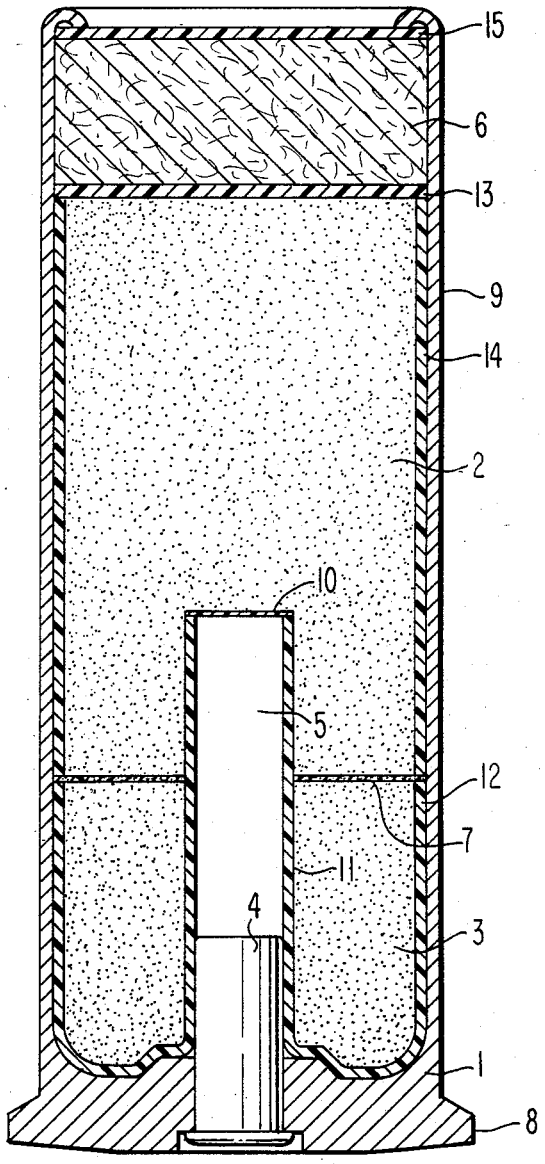
15
6
13
9
14
2
10
5
12
7
11
4
3
1
8

INDUSTRIAL CARTRIDGE WITH SEPARATED DEFLAGRATING COMPONENTS

The invention relates to an industrial cartridge with a case that contains a propellant charge and that has an igniter-containing base at one end and that has an ignition-transmitting tube arranged axially within the case for effecting ignition of the propellant charge.

It is known to burst open or break away natural rock, concrete, masonry, and the like, by use of a shot hole having a specific depth and a specific diameter and by the use of a blasting cartridge or a special device with propellant cartridges placed in the shot hole. German Pat. No. 1,195,696 describes a device for saturation blasting. While, with the use of blasting cartridges, detonation occurs after ignition, propellant cartridges contain a propellant charge that burns relatively slowly (deflagration; i.e., slow). Customarily, blasting cartridges are inserted and ignited in the zone of the lower third of the shot hole, preferably at or close to the bottom of the shot hole. A commercially available special device, containing propellant cartridges, is the so-called ROCK-BREAKER by the firm of H. Jürgen Essig, Berlin. After introduction of the blasting cartridge or of the special device with a propellant cartridge, water can additionally be filled into the shot hole as tamping and/or trimming agent. The water serves, inter alia, to effect pressure transmission from the combustion gases to the shot hole wall and the base of the shot hole. In case of the ROCK-BREAKER, the pressure produced after ignition of an industrial cartridge mounted in the device is transmitted to the water introduced into the shot hole by way of an impulse tube with radial openings. The hydrodynamic impulse effects the desired fissuring, for example, of rock or concrete. The aforementioned device exhibits, in the operating position, a cylindrical rubber cuff below the impulse tube, this cuff being expanded via radial bores in the tube wall after ignition of the cartridge, thereby providing stabilization of the device in the shot hole.

Voluminous safety measures must be taken when using blasting cartridges. Handling of the cartridges must be left to an expert with appropriate training.

The devices operated with propellant cartridges, such as the above-described ROCK-BREAKER, can be utilized with a lower degree of safety measures as compared with the use of blasting cartridges.

The cartridges employed for this purpose are usually designed so that they give off a short-term gas pressure impulse after ignition of the propellant charge. However, with the aid of such cartridges, stone and rock masses and the like objects can be comminuted only with difficulties even when employing suitable devices, if these objects; e.g., stones, are large and/or exhibit high strength. Thus, when breaking up material with the ROCK-BREAKER, the maximum size of the material to be split is limited to edge lengths along the area containing the upper shot hole rim of about 40–50 cm, or to tubes of between 1 and 1.2 $m^3$. With a size of above 1.2 $m^3$, several shot holes must be used. These difficulties cannot be avoided, either, by means of a cartridge having a larger propellant charge, since in such a case merely the gas pressure in the shot hole is raised, which without effect escapes through cracks in the material to be cleaved that are close to the shot hole, and does not cause an enlargement of the fissure produced in the material after ignition of the propellant charge.

The invention is based on the object of breaking up natural rock, concrete, masonry, and the like more effectively than with the conventional means. This object has been attained by an industrial propellant cartridge which as a propellant charge comprised of at least two successively arranged propellant charge powders deflagrating at different speeds, the powders being separated by a gas-permeable cover extending transversely to the case axis; an ignition-transmitting tube that has a cover at the level of the separated charge powder which is the second and/or last charge powder as seen from the base, the cover being thinner than the wall of the ignition-transmitting rube; and the case containing at the other end opposite to the base a seal of a compressible material.

The industrial cartridge of this invention contains a propellant charge of at least two successively arranged propellant charge powders deflagrating at differing speeds. This has the effect that the cartridge, after transmitting the primary pressure impulse, produces at least one further gas pressure impulse whereby the material to be broken up already containing a crack, will be completely comminuted. The cartridge of this invention has the additional advantage that the propellant charge contained therein can be designed optimally in correspondence with the requirements for adaptation of the strength of the charge to the material to be broken up. Thereby, the risk of falling or flying rocks on account of an excessive charge is lessened. A further advantage is the enhanced possibility of dimensioning the propellant charge and/or its strength when cleaving valuable material, for example, in marble quarries where the stress on the material to be broken up is to be kept to a minimum.

In an advantageous embodiment of the industrial cartridge, the cartridge contains two successively arranged propellant charge powders deflagrating at differing speeds. This may be achieved by selection of well known propellant powders of different chemical composition.

According to another feature of the invention, the cartridge can also contain propellant charge powders of varying grain sizes, form and/or porosity. This is another possibility fof determining and/or affecting the deflagration veloxity of the powders.

A structure of the industrial cartridge wherein a thin sheet is provided as a cover for the ignition-transmitting tube, is a preferred solution effecting, in an especially simple fashion, a successive ignition of the propellant charge powders in the desired sequence.

In another feature of the invention which provides the most favorable structure of the closure of the case is a seal that is compressible to 25 to 30% of its original volume. By the high compressibility of the closure material, the objective is attained that the propellant charge powder arranged thereunder starts to burn in its entirety before the thus-generated gas can escape.

The industrial cartridge of this invention can be utilized in various devices for different industrial areas. Thus, it is also possible, for example, to blast off slag residues in the metal-producing industry with the aid of the cartridge.

The invention will be described hereinafter in greater detail with reference to an embodiment illustrated in the sole FIGURE of the accompanying drawing.

The FIGURE shows an industrial cartridge in a longitudinal sectional view. The case 9 with the case 1 at one end contains the propellant charge powders 2, 3.

The cylindrical case and the base consist, for example, of aluminum, brass, or a synthetic resin, such as, for instance, polyethylene. They can be made of one piece or of two parts. The propellant powders 2, 3 are advantageously nitrocellulose powders optionally containing nitroglycerin. They differ in their deflagration velosities. Preferably, propellant charge powder 2 burns faster than propellant charge powder 3. The more rapidly deflagrating powder requies approximately a tenfold time period for combustion as compared with substances utilized as explosives. The more gradually deflagrating powder requires e.g. about twice the time period for combustion as compared with the more rapidly deflagrating powder. The differing deflagration speeds of the propellant charge powders are obtained conventionally by varying composition, grain size, form and/or porosity of the powders. In a preferred embodiment the relation of the higher to the lower deflagration speed of the powders 2 and 3 is between about 1.5 to 3.

The propellant charge powder 3, which is located closer to the base, is ignited later than the propellant charge powder 2. The difference amounts to about 1/100 second. This is achieved by igniting propellant charge powder 2 by the ignition vapors of a mechanically or electrically triggered igniter 4 directly by way of an axially arranged ignition-transmitting tube 5 which is open at the end facing away from the base 1; this tube is provided with a closure 10 and optionally with radial ignition apertures (not shown) in the zone of the propellant charge powder 2. The ignition-transmitting tube 5 and the closure 10 can also be designed to be integrally connected; for example, these elements can be injection-molded in one working step from a synthetic resin. The closure 10 is thinner than the wall 11 of the ignition-transmitting tube. Preferably, the closure 10 consists of a thin sheet having a thickness of about 0.2 mm. The propellant charge powder 3 is ignited secondarily by the flame produced after ignition of the propellant charge powder 2. The ignition-transmitting tube 5 extends with its closure to at least up to level of the propellant charge powder 2. Preferably, it extends also into the charge powder 2 over at least ⅓ of the axial length of the latter as shown.

The propellant charge powders 2, 3 are separated completely from each other by a gas-permeable cover 7 extending transversely with respect to the case. The gas-permeable cover 7 consists, for example, of felt, a fabric, a foam material, or disks, provided with predetermined rupturing sites, made of a metal—such as aluminum, for example—or a synthetic resin. The gas-permeable cover 7 is held by a cup 12 consisting preferably of a synthetic resin, such as, for example, polyethylene. The cup 12 is formed integrally with tube 11 for easily fastening this tube. Of course, distance element 12 could also be in the form of a separate sleeve.

The case 9 contains a compressible seal 6 at the other end opposite to the base 1. The seal 6 is preferably retained on an inner sleeve 14 (inserted into the case) by means of a disk 13. However, the seal can also be mounted in some other way, for example, by internal projections extending from the case 9. The seal 6 preferably consists of fur felt, the disk 13 and the inner sleeve 14 consists of polyethylene. The seal 6 could consist, however, e.g. also of cotton-wool, thermoplastic foam or any other easily compressible material. The seal 6 is held, at the end of case 9 in opposition to the base 1, by means of another disk 15, likewise, preferably made of polyethylene. The seal 6 is compressible to 25–30% of its original volume. Compression is caused by the gases generated after ignition of propellant charge powder 2. Within the compression period, lasting only microseconds, the propellant charge powder 2 is entirely ignited. Thereafter, by the increased gas pressure, the seal 6 and the disks 13, 15 are ruptured or blown out of the case 9, and the thus-produced gas flows outwardly.

The cartridge of this invention is provided with a case rim 8 in such a way that the cartridge cannot be used in commercially available firearms, such as, for example, flare guns.

What is claimed is:

1. An industrial cartridge comprising a case containing a propellant charge, a base in one end of the case, and an ignition-transmitting tube arranged axially in the case, said tube being positioned on the base with an igniter arranged therein; said propellant charge being composed of at least two successively arranged propellant charge powders deflagrating at differing speeds, the powders being separated by a gas-permeable cover extending transversely to the case axis; the ignition-transmitting tube being provided with a cover at the level of the propellant charge powder which is the second and/or last charge powder as seen from the base, the cover being thinner than the wall of the ignition-transmitting tube; and the case containing, at the other end opposite to the base, a seal of a compressible material.

2. An industrial cartridge according to claim 1, wherein the case contains, in succession, two propellant charge powders; the first propellant charge powder, located at the level of the cover of the ignition-transmitting tube, deflagrating more rapidly than the second propellant charge powder arranged after the first propellant charge powder.

3. An industrial cartridge according to claim 1, wherein the propellant charge powders exhibit differing grain sizes.

4. An industrial cartridge according to claim 2, wherein the propellant charge powders exhibit differing grain sizes.

5. An industrial cartridge according to claim 1, wherein the cover of the ignition-transmitting tube consists of a thin sheet having a thickness of about 0.2 mm.

6. An industrial cartridge according to claim 2, wherein the cover of the ignition-transmitting tube consists of a thin sheet having a thickness of about 0.2 mm.

7. An industrial cartridge according to claim 3, wherein the cover of the ignition-transmitting tube consists of a thin sheet having a thickness of about 0.2 mm.

8. An industrial cartridge according to claim 1, wherein the seal of the case is compressible to 25–30% of its original volume.

9. An industrial cartridge according to claim 2, wherein the seal of the case is compressible to 25–30% of its original volume.

10. An industrial cartridge according to claim 3, wherein the seal of the case is compressible to 25–30% of its original volume.

11. An industrial cartridge according to claim 5, wherein the seal of the case is compressible to 25–30% of its original volume.

* * * * *